US006978502B2

(12) United States Patent
Calagui

(10) Patent No.: US 6,978,502 B2
(45) Date of Patent: Dec. 27, 2005

(54) PILLOW

(76) Inventor: Juanito B. Calagui, P.O. Box 325, Passaic, NJ (US) 07055

( * ) Notice: Subject to any disclaimer, the term of this patent is extended or adjusted under 35 U.S.C. 154(b) by 0 days.

(21) Appl. No.: 10/780,138

(22) Filed: Feb. 17, 2004

(65) Prior Publication Data

US 2004/0139550 A1 Jul. 22, 2004

(51) Int. Cl.[7] ..... A47C 27/00
(52) U.S. Cl. ..... 5/640; 5/636; 5/645
(58) Field of Search ..... 5/640, 636, 730, 5/657, 736, 727, 644–645

(56) References Cited

U.S. PATENT DOCUMENTS

| | | | | |
|---|---|---|---|---|
| 3,243,828 A | | 4/1966 | McCarty | 5/636 |
| 3,924,283 A | | 12/1975 | Shave | 5/636 |
| 4,850,068 A | | 7/1989 | Walpon et al. | 5/636 |
| 5,388,296 A | | 2/1995 | Mansour | 5/638 |
| 5,528,784 A | | 6/1996 | Painte | 5/640 |
| 5,638,564 A | * | 6/1997 | Greenawalt et al. | 5/636 |
| 5,647,076 A | * | 7/1997 | Gearhart | 5/631 |
| 5,727,266 A | | 3/1998 | Pang | 5/636 |
| 5,940,913 A | * | 8/1999 | Horowitz | 5/640 |
| 5,953,779 A | * | 9/1999 | Schwartz | 5/722 |
| 6,311,351 B1 | * | 11/2001 | Murphy | 5/727 |
| 6,363,557 B2 | * | 4/2002 | Chou | 5/645 |

FOREIGN PATENT DOCUMENTS

| | | | |
|---|---|---|---|
| DE | 2009792 | 11/1970 | 5/636 |
| DE | 2701557 | 7/1978 | 5/636 |

* cited by examiner

*Primary Examiner*—Heather Shackelford
*Assistant Examiner*—Fredrick Conley
(74) *Attorney, Agent, or Firm*—Walter J. Tencza, Jr.

(57) ABSTRACT

An apparatus is disclosed including a left end piece, a right end piece, and a pillow. The left end piece may have a recess into which a left portion of the pillow can be inserted. The right end piece may have a recess into which a right portion of the pillow can be inserted. The pillow may be substantially softer than the left end piece and the right end piece. The pillow, the left end piece, and the right end piece can be inserted into a sleeve.

16 Claims, 6 Drawing Sheets

PILLOW

FIELD OF THE INVENTION

This invention relates to improved methods and apparatus concerning pillows.

BACKGROUND OF THE INVENTION

Various types of pillows are known in the prior art.

SUMMARY OF THE INVENTION

The present invention in one or more embodiments provides an apparatus comprising a left end piece, a right end piece, and a pillow. The left end piece may have a recess into which a left portion of the pillow can be inserted. The right end piece may have a recess into which a right portion of the pillow can be inserted. The pillow may be substantially softer than the left end piece and the right end piece. The recess of the left end piece and the recess of the right end piece may have a width and a height, which is about the same as a width, and a height of the pillow.

The apparatus may further include a sleeve. The pillow, the left end piece, and the right end piece can be inserted into the sleeve while the left portion of the pillow is inserted into the recess of the left end piece and while the right portion of the pillow is inserted into the recess of the right end piece. The apparatus may further include a pillow covering. The sleeve, the pillow, the left end piece, and the right end piece can be inserted into the pillow covering, while the left portion of the pillow is inserted into the recess of the left end piece, while the right portion of the pillow is inserted into the recess of the right end piece, and while the pillow, left end piece, and right end piece are inserted into the sleeve.

The present invention in one or more embodiments also includes a method comprising the steps of inserting a right portion of a pillow into a recess of a right end piece, inserting a left portion of a pillow into a recess of a left end piece, and wherein the pillow is substantially softer than the left end piece and the right end piece. The method may include inserting the pillow, the left end piece, and the right end piece into a sleeve while the left portion of the pillow is inserted into the recess of the left end piece and while the right portion of the pillow is inserted into the recess of the right end piece.

DETAILED DESCRIPTION OF THE DRAWINGS

Figure 1:
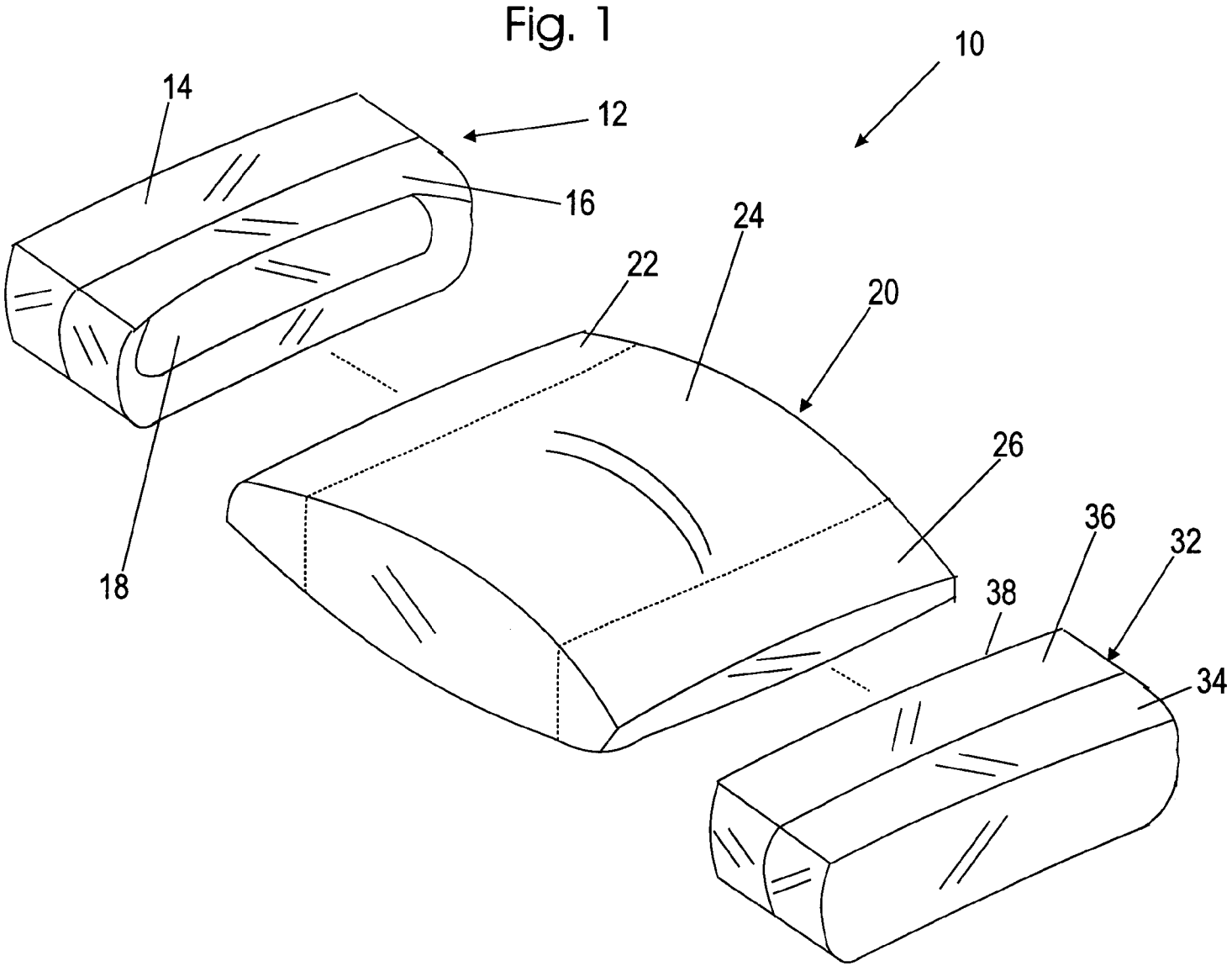
FIG. 1 shows a perspective view of an apparatus in accordance with an embodiment of the present invention with the apparatus shown taken apart.
Figure 2:
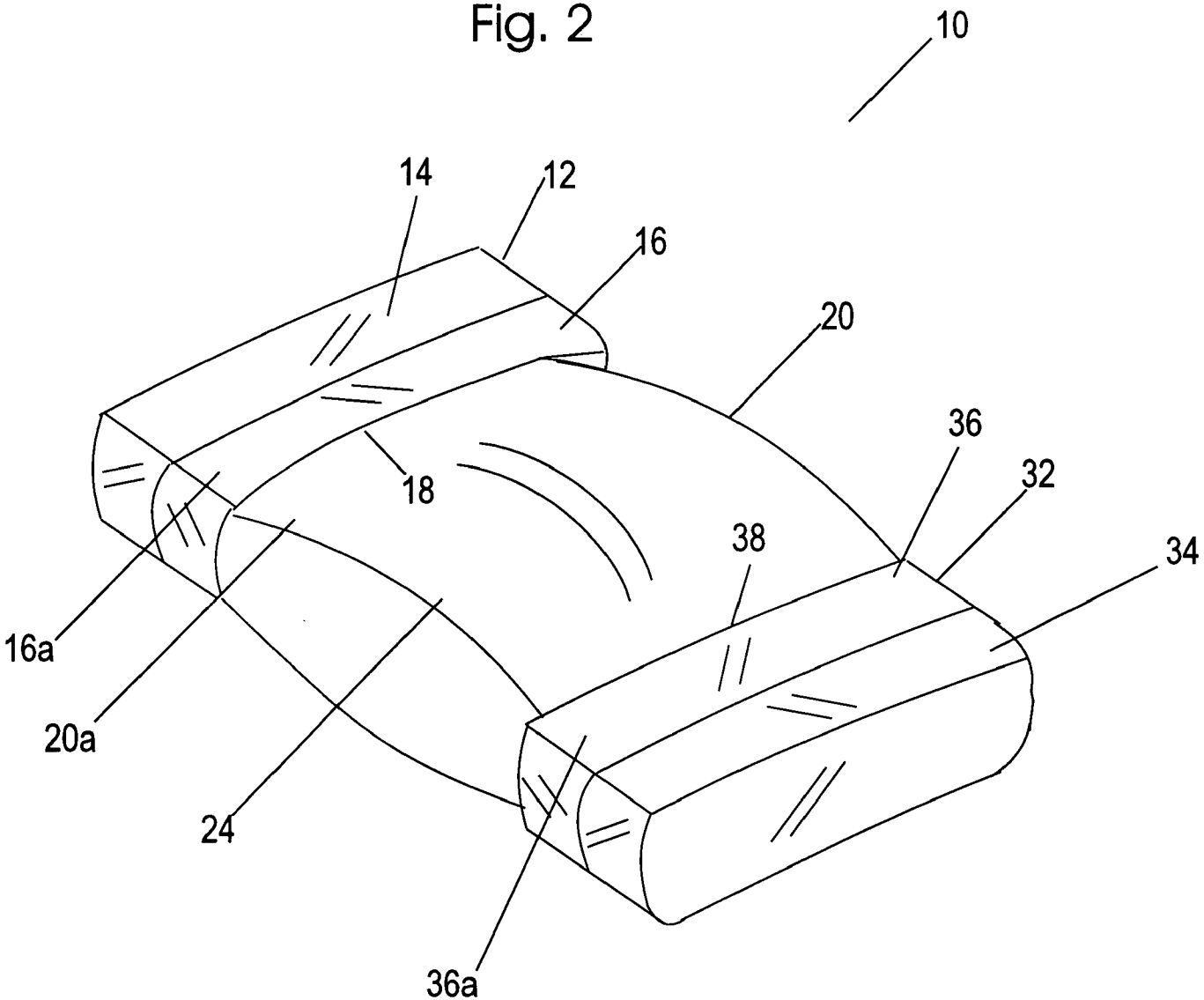
FIG. 2 shows a perspective view of the apparatus of FIG. 1 with the apparatus shown put together.

FIG. 1 shows a perspective view of an apparatus 10 in accordance with an embodiment of the present invention with the apparatus 10 shown taken apart. FIG. 2 shows a perspective view of the apparatus 10 of FIG. 1 with the apparatus 10 shown put together. The apparatus 10 includes a conventional pillow 20, a left end piece 12, and a right end piece 32.

The left end piece 12 may be comprised of portions 14 and 16. Portion 14 may be solid and made of a foam material. Portion 16 may also be made of a foam material, but may have an indentation or recess 18. Right end piece 32 may be identical to left end piece 12. Right end piece 32 may have a portion 34 and a portion 36. The portion 34 may be solid and made of a foam material like portion 14. The portion 36 may also be made of a foam material, but may have an indentation or recess 38. The portions 14 and 16 may be integrated together as one piece. The portions 34 and 36 may also be integrated together as one piece.

The pillow 20 may be one piece, but for description purposes may be described as having portions 22, 24, and 26. In operation, as shown by the FIGS. 1 and 2, the portion 22 of the pillow 20 may be inserted into the recess 18 of the left end piece 12. Similarly the portion 26 of the pillow 20 may be inserted into the recess 38 of the right end piece 32.

The pillow 20 may be made of a substantially softer material than the left end piece 12 or the right end piece 32. For example, the left end piece 12 and the right end piece 32 may be made of a substantially harder foam which does not give as easily (i.e. is not as elastic) or is not compressed as easily as a relatively softer foam for the pillow 20. This is done, so that, in at least one embodiment, a person's head resting on the pillow 20, compresses the pillow 20 downward, and if the person then rolls his or her head too far left or too far right, his or her head will be restrained from rolling any further by the left end piece 12 or the right end piece 32, respectively. If the left end piece 12 and the right end piece 32 had the same elasticity as the pillow 20, then the surface 20*a* of the pillow 20, even after compression by someone's resting head, would be even, or substantially even, with the surfaces 16*a* and 36*a* of the left end piece 12 and the right end piece 32, respectively. Providing a substantially softer material for the pillow 20 than the left end piece 12 and the right end piece 32, effectively creates walls at the junction of pillow 20 and left end piece 12 and the junction of pillow 20 and right end piece 32.

Figure 3:
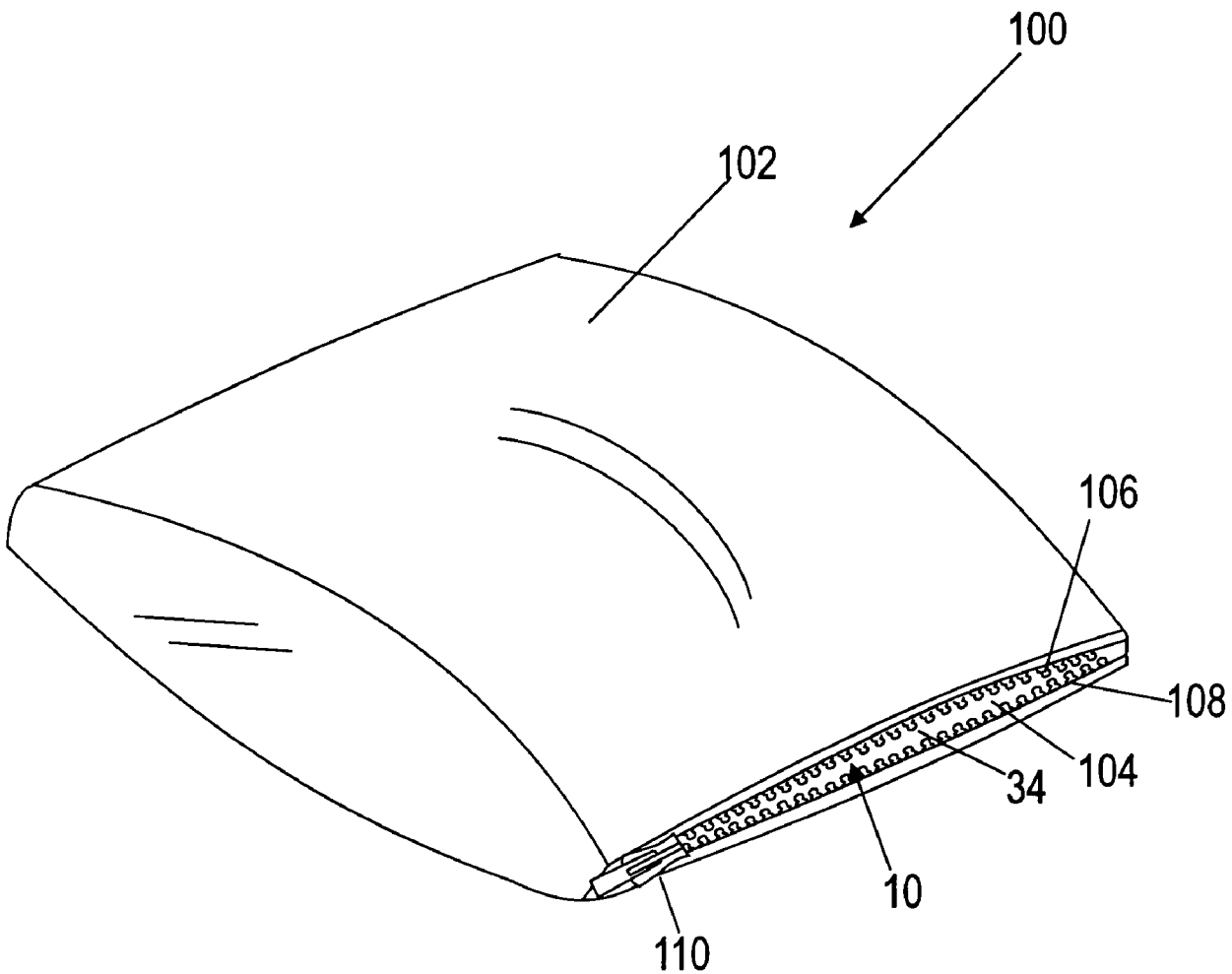
FIG. 3 shows a perspective view of a sleeve into which the apparatus of FIG. 2 can be inserted.

FIG. 3 shows a perspective view of a sleeve 100. The apparatus 10, as assembled in FIG. 2 can be inserted into the sleeve 100. The sleeve 100 includes an outer covering 102 and a cavity or chamber 104 into which the apparatus 10 can be inserted. Closing zipper 110, which zips together upper zipper teeth 106 and lower zipper teeth 108, can close the chamber 104.

Figure 4:
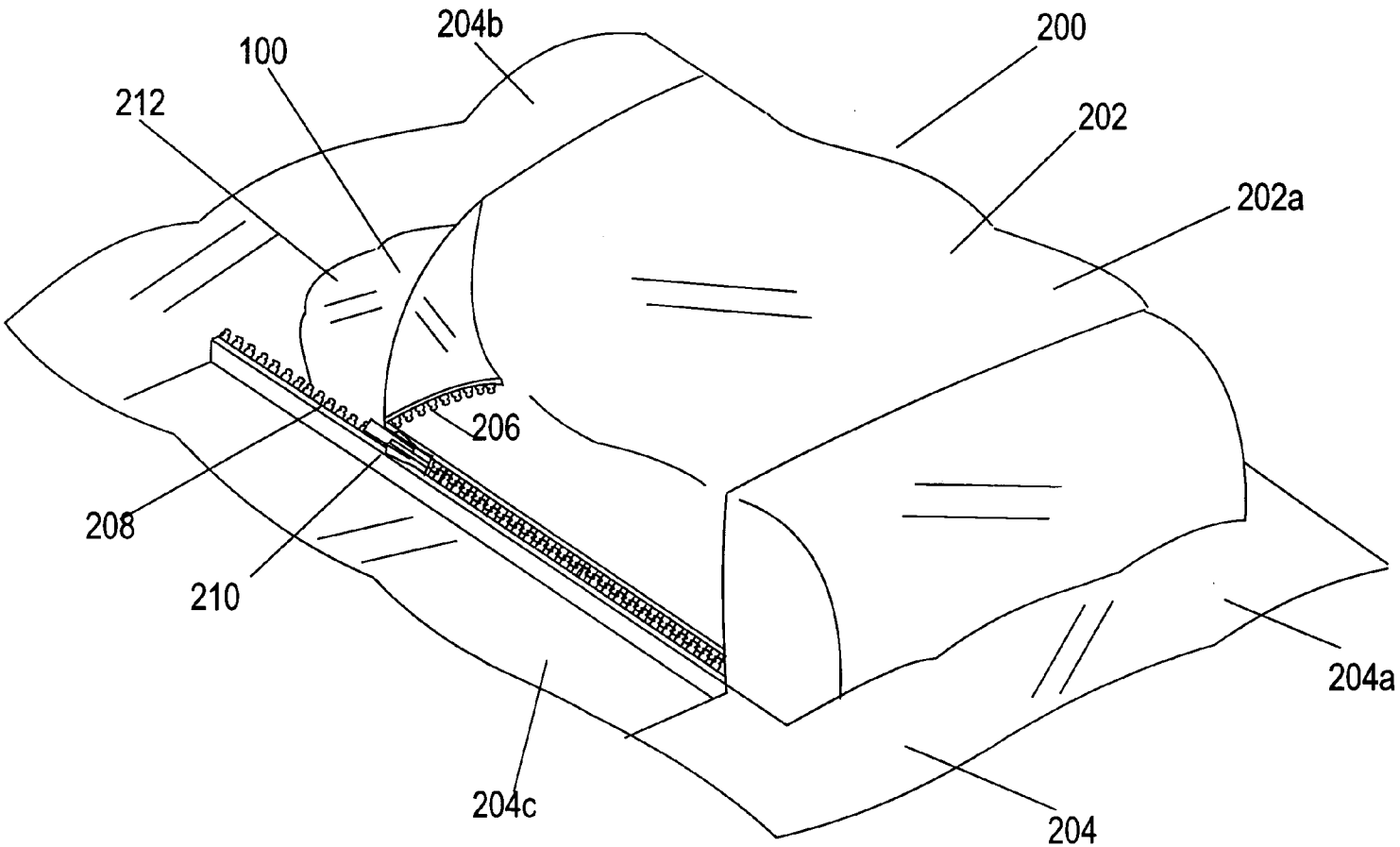
FIG. 4 shows a perspective view of a pillow covering into which the sleeve of FIG. 3 and the apparatus of FIG. 2 can be inserted, with the pillow covering shown in a partially unzipped state.
Figure 5:
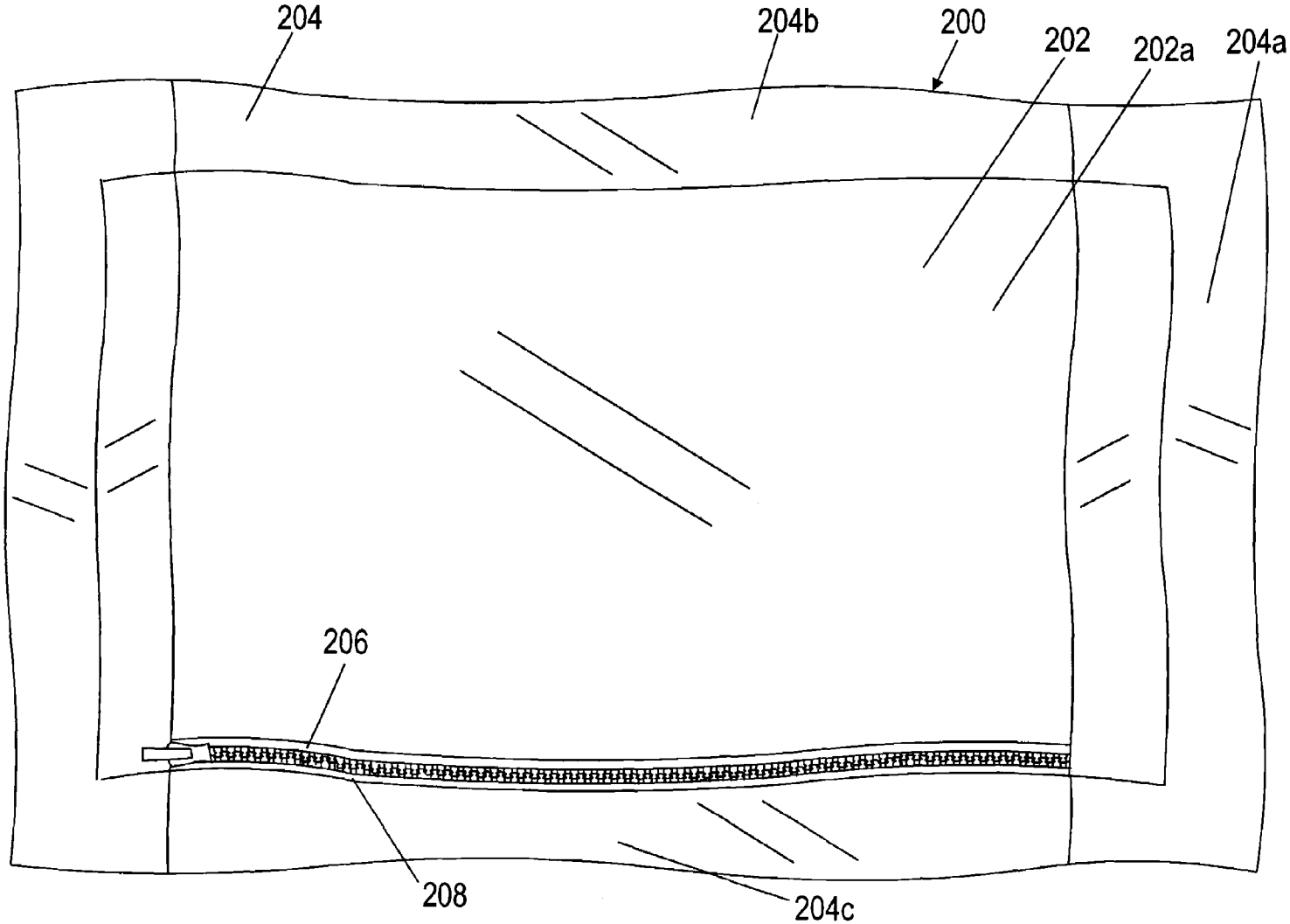
FIG. 5 shows a bottom view of the pillow covering of FIG. 4 with the pillow covering of FIG. 4 shown in a completely zipped up state.
Figure 6:
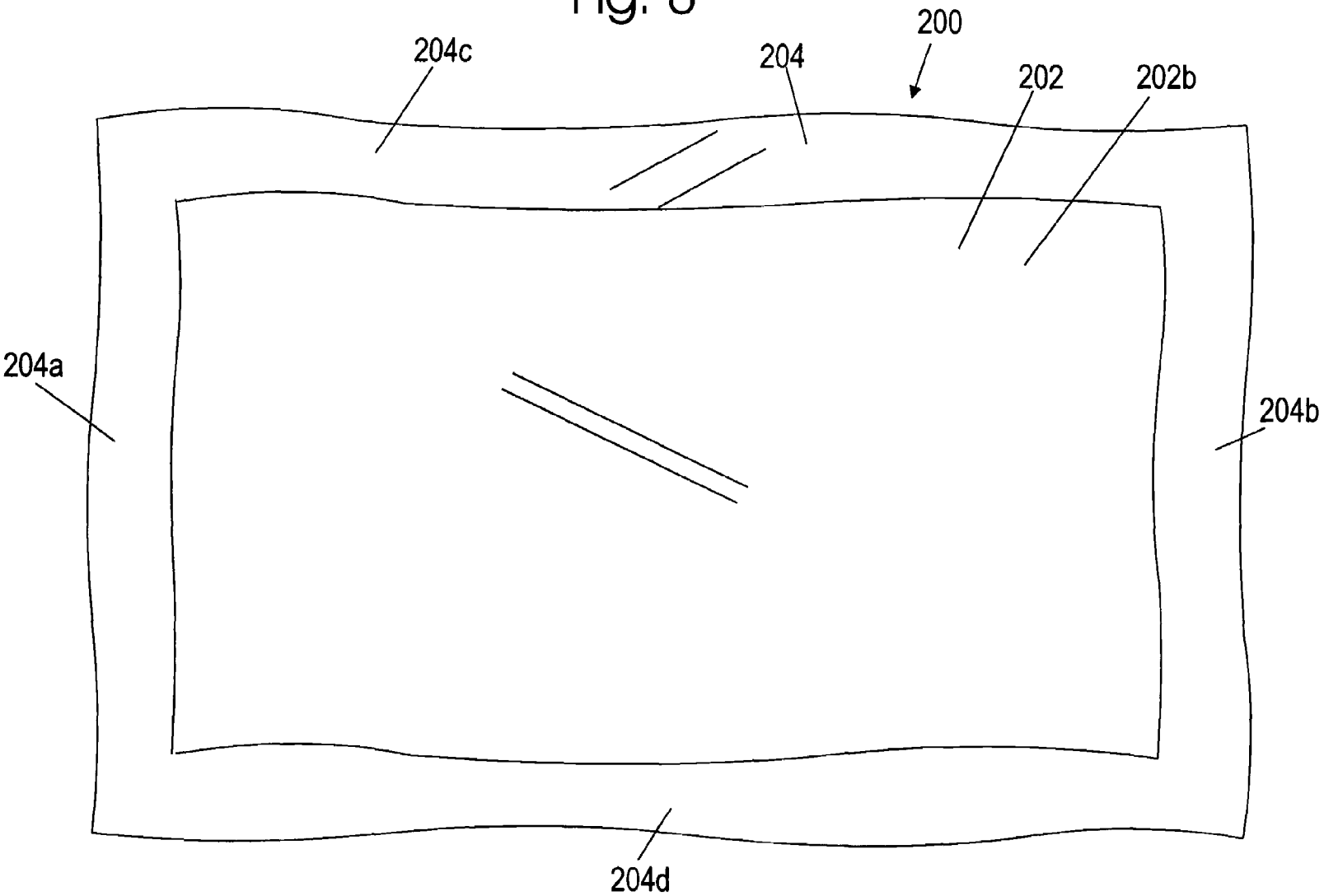
FIG. 6 shows a top view of the pillow covering of FIG. 4.

FIG. 4 shows a perspective view of a pillow covering 200 into which the sleeve 100 and the apparatus 10 as inserted in the sleeve 100, can be inserted. The pillow covering 200 is shown in FIG. 4 in a partially unzipped state. FIG. 5 shows a bottom view of the pillow covering 200 of FIG. 4 with the pillow covering 200 of FIG. 4 shown in a completely zipped up state. FIG. 6 shows a top view of the pillow covering 200 of FIG. 4.

The pillow covering 200 includes a central portion 202 having a bottom surface 202*a*, shown in FIGS. 4 and 5. The pillow covering 200 also includes a peripheral portion 204 having portions 204*a*, 204*b*, 204*c*, and 204*d*. The central portion 202 and the peripheral portion 204 may be made out of a material such as a fabric. The pillow covering also includes zipper 210, which can join or separate zipper teeth 206 and 208. The pillow covering 200 includes a chamber or cavity 212, shown partially in FIG. 4, into which the sleeve 100 and apparatus 10 can be inserted upon unzipping the zipper teeth 206 and 208. FIG. 6 shows a top surface 202*b* of the central portion 202. The top view shown in FIG. 6 typically does not show a zipper 210.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a left end piece;

a right end piece; and a pillow;

wherein the left end piece has a recess into which a left portion of the pillow can be inserted;

wherein the right end piece has a recess into which a right portion of the pillow can be inserted;

wherein the pillow is substantially softer than the left end piece and the right end piece;

wherein the right end piece overlaps the right portion of the pillow when the tight portion of the pillow is in the recess of the right end piece; and wherein the left end piece overlaps the left portion of the pillow when the left portion of the pillow is in the recess of the left end piece.

2. The apparatus of claim 1 wherein the recess of the left end piece and the recess of the right end piece have a width, which is about the same as a dimension of the pillow.

3. The apparatus of claim 1 wherein the recess of the left end piece and the recess of the right end piece have a width and a height, which is about the same as a width, and height of the pillow.

4. The apparatus of claim 1 further comprising a sleeve; and wherein the pillow, the left end piece, and the right end piece can be inserted into the sleeve while the left portion of the pillow is inserted into the recess of the left end piece and while the right portion of the pillow is inserted into the recess of the tight end piece.

5. The apparatus of claim 4 further comprising a pillow covering; and wherein the sleeve, the pillow, the left end piece, and the right end piece can be inserted into the pillow covering, while the left portion of the pillow is inserted into the recess of the left end piece, while the right portion of the pillow is inserted into the recess of the right end piece, and while the pillow, left end piece, and right end piece are inserted into the sleeve.

6. The apparatus of claim 1 wherein the right portion of the pillow has a top surface and a bottom surface;

wherein the right end piece overlaps the top and bottom surfaces of the right portion of the pillow when the right portion of the pillow is in the recess of the right end piece;

wherein the left portion of the pillow has a top surface and a bottom surface; and wherein the left end piece overlaps the top and bottom surfaces of the left portion of the pillow when the left portion of the pillow is in the recess of the left end piece.

7. The apparatus of claim 1 further comprising a sleeve; and wherein the pillow, the left end piece, and the right end piece can be inserted into the sleeve while the left portion of the pillow is inserted into the recess of the left end piece and while the right portion of the pillow is inserted into the recess of the right end piece.

8. The apparatus of claim 7 further comprising a pillow covering; and wherein the sleeve, the pillow, the left end piece, and the right end piece can be inserted into the pillow covering, while the left portion of the pillow is inserted into the recess of the left end piece, while the right portion of the pillow is inserted into the recess of the right end piece, and while the pillow, left end piece, and right end piece are inserted into the sleeve.

9. A method comprising the steps of inserting a right portion of a pillow into a recess of a right end piece;

inserting a left portion of a pillow into a recess of a left end piece; and wherein the pillow is substantially softer than the left end piece and the right end piece;

wherein the right and piece overlaps the right portion of the pillow when the right portion of the pillow is in the recess of the right end piece; and wherein the left end piece overlaps the left portion of the pillow when the left portion of the pillow is in the recess of the left end piece.

10. The method of claim 9 wherein the recess of the left end piece and the recess of the right end piece have a width, which is about the same as a dimension of the pillow.

11. The method of claim 9 wherein the recess of the left end piece and the recess of the right end piece have a width and a height, which is about the same as a width, and height of the pillow.

12. The method of claim 9 further comprising inserting the pillow, the left end piece, and the right end piece into a sleeve while the left portion of the pillow is inserted into the recess of the left end piece and while the right portion of the pillow is inserted into the recess of the right end piece.

13. The method of claim 12 further comprising inserting the sleeve, the pillow, the left end piece, and the right end piece into a pillow covering, while the left portion of the pillow is inserted into the recess of the left end piece, while the right portion of the pillow is inserted into the recess of the right end piece, and while the pillow, left end piece, and right end piece are inserted into the sleeve.

14. The method of claim 9 wherein the right portion of the pillow has a top surface and a bottom surface;

wherein the right end piece overlaps the top and bottom surfaces of the right portion of the pillow when the right portion of the pillow is in the recess of the right end piece;

wherein the left portion of the pillow has a top surface and a bottom surface; and wherein the left end piece overlaps the top and bottom surfaces of the left portion of the pillow when the left portion of the pillow is in the recess of the left end piece.

15. The method of claim 9 further comprising inserting the pillow the left end piece, and the right end piece into a sleeve while the left portion of the pillow is inserted into the recess of the left end piece and while the right portion of the pillow is inserted into the recess of the right end piece.

16. The method of claim 15 further comprising inserting the sleeve, the pillow, the left end piece, and the right end piece into a pillow covering, while the left portion of the pillow is inserted into the recess of the left end piece, while the right portion of the pillow is inserted into the recess of the right end piece, and while the pillow, left end piece, and right end piece are inserted into the sleeve.

* * * * *